US005682640A

United States Patent [19]

Han

[11] Patent Number: 5,682,640

[45] Date of Patent: Nov. 4, 1997

[54] POWER SUPPLY APPARATUS FOR AUTOMATIC VACUUM CLEANER

[75] Inventor: Suk-Jin Han, Suwon, Rep. of Korea

[73] Assignee: Samsung Electronics Co., Ltd., Suwon, Rep. of Korea

[21] Appl. No.: 415,206

[22] Filed: Mar. 31, 1995

[30] Foreign Application Priority Data

Mar. 31, 1994 [KR] Rep. of Korea ..... 94-6850 U

[51] Int. Cl.[6] ..... A47L 9/28

[52] U.S. Cl. ..... 15/319; 15/323; 15/339; 15/340.1

[58] Field of Search ..... 15/319, 339, 340.1

[56] References Cited

U.S. PATENT DOCUMENTS 2,248,699 7/1941 Finnell ..... 15/320

2,317,843 4/1943 Backlund ..... 15/320 X 5,012,886 5/1991 Jonas ..... 15/340.1 X 5,109,566 5/1992 Kobayashi et al. ..... 15/319

*Primary Examiner*—Chris K. Moore

*Attorney, Agent, or Firm*—Burns, Doane, Swecker & Mathis, L.L.P.

[57] ABSTRACT

An automatic self-propelled vacuum cleaner includes an electrical power supply cord having a plug. The plug carries latches which can be coupled to either the vacuum cleaner or a wall-mounted socket. The vacuum cleaner carries a light beam receiver which receives a light beam signal emitted from the socket for guiding the vacuum cleaner toward the socket.

7 Claims, 5 Drawing Sheets

POWER SUPPLY APPARATUS FOR AUTOMATIC VACUUM CLEANER

BACKGROUND OF THE INVENTION

1. Field of the Invention

The present invention relates to a power supply apparatus for an automatic vacuum cleaner in which a plug means may be inserted into a socket on a wall or be separated from the socket.

2. Description of the Prior Art

A conventional automatic vacuum cleaner, as shown in FIG. 1, which comprises a motor 3 for generating suction force toward a body 1, a dust collecting chamber 5 for collecting dust and foreign materials sucked by operation of the motor 3, a plurality of driving wheels 7 for moving the body in forward, backward, left and right directions, a plurality of auxiliary wheels 9 for supporting the body 1, a suction brush 11 for conducting dust and foreign materials sucked by the motor 3. The suction brush 11 is at one side thereof in contact with a floor to be cleaned, and is at the other side thereof connected to the dust collecting chamber 5.

Meanwhile, the body 1 is at a top side thereof provided with power cord activating means 15 to draw in or permit extraction of the power cord 13. The power cord activating means 15 is disposed below a control means 17 to control the automatic vacuum cleaner's movement. The power cord 13 is at one side thereof attached to a plug 19 to be electrically connected with a socket not shown.

In the conventional vacuum cleaner as constructed above, when an user operates an operation switch (not shown) within the control means 17 after the plug 19 is inserted into the socket, the motor 3 within the body 1 is operated to thereby generate suction into the dust collecting chamber 5, and to thereby suck dust and foreign materials from the floor into the dust collecting chamber 5 through the suction brush 11. Accordingly, the dust collecting chamber 5 collects dust and foreign materials, and cleaning air is discharged outside.

Furthermore, the automatic vacuum cleaner is moved a predetermined distance under the control of the control means 17 due to operation of the driving wheels 7 by the motor 3. At this time, the power cord 13 is drawn in or extracted from the power cord activating means 15 in order to enable power to be supplied to the cleaner.

However, the conventional automatic vacuum cleaner has a problem in that the plug must be inserted into or separated from the socket by the user manually.

SUMMARY OF THE INVENTION

It is, therefore, an object of the present invention to provide a power supply apparatus for an automatic vacuum cleaner in which the above problem can be overcomed and plug means of the cleaner can be automatically coupled with a socket means on the wall when the cleaner starts its cleaning operation at a first predetermined area, and is automatically separated from the socket means in order to be moved to a second predetermined area to be cleaned when the cleaner has finished its cleaning operation at the first predetermined area.

The present invention provides a power supply apparatus for an automatic vacuum cleaner in which the apparatus comprises: a cleaner body; power cord in/out drawing means for drawing in/out a power cord; control means for controlling the cleaner's movement, the apparatus further comprising; plug means connected to one end of the power cord; consent means placed at a predetermined area on an wall, for electrically coupling the same to the plug means; a light emitting unit placed in the consent means, for emitting light signal to lead the cleaner to a predetermined area; a light receiving unit placed in the cleaner, for receiving the light signal emitted from the light emitting unit.

BRIEF DESCRIPTION OF THE DRAWINGS

Other objects and aspects of this invention will become apparent from the following description of embodiments with reference to the accompanying drawings, in which.

DESCRIPTION OF A PREFERRED EMBODIMENT

Figure 1:
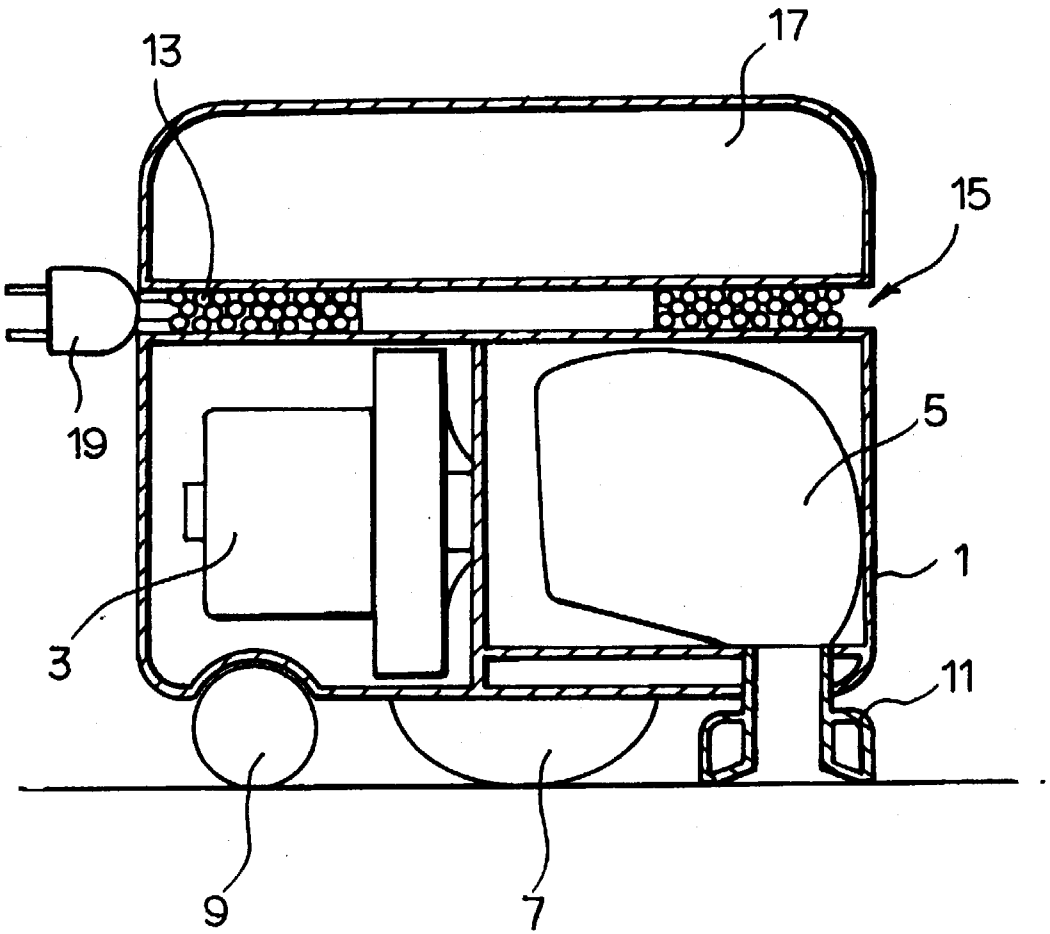
FIG. 1 (Prior Art)
FIG. 1 is a longitudinal cross sectional view of a conventional automatic vacuum cleaner.

As shown in FIGS. 2 to 5, a body 1 is at an upper side thereof formed with power cord activating drawing means 15 to draw in or permit extraction of a power cord which carries plug means 30. As explained earlier, the cord supplies electric power to a motor 3 which functions to generate suction power and drive the driving wheels 7. Socket means 50 is placed at a predetermined area on a wall 25 in order to receive the plug means 30. A light emitting unit 71 is placed at a predetermined area in the socket means 50 for emitting a light signal to guide the body 1 to the consent means 50. A light receiving unit 73 is placed at a predetermined area in control means 17 disposed on the upper side of the power cord activating means 15 for receiving the light signal emitted from the light emitting unit 71.

The control means 17 is provided therein with a battery (not shown) for supplying electric power to the cleaner.

The body 1 is at a left side thereof formed with a first receiving groove 21 (see FIG. 4) for receiving a first protrusion 31 of the plug means in order to prevent the plug means 30 from dropping downward. The first receiving groove 21 is at an upper side thereof formed with a first locker 23 for attachment to locking latches 34*a*, 34*b*.

The body 51 of the socket means 50 is at a right side thereof formed with a second receiving groove 53 (see FIG. 5) for receiving a second protrusion 35 of plug means 30 in order to prevent the plug means 30 from dropping downward. The second receiving groove 53 is at an upper side thereof formed with a second locker 55 for attachment to the latches 33*a*, 33*b*.

Furthermore, the body 51 is provided therein with contact terminals 59*a*, 59*b* (FIG. 3) which are electrically connected to wires 57*a*, 57*b* protruded through the wall 25.

The contact terminals 59*a*, 59*b* are formed with terminal receiving grooves for receiving connecting terminals 37*a*, 37*b* of the plug means 30.

A plurality of socket means 50 are provided at predetermined areas on the wall 25.

Figure 2:
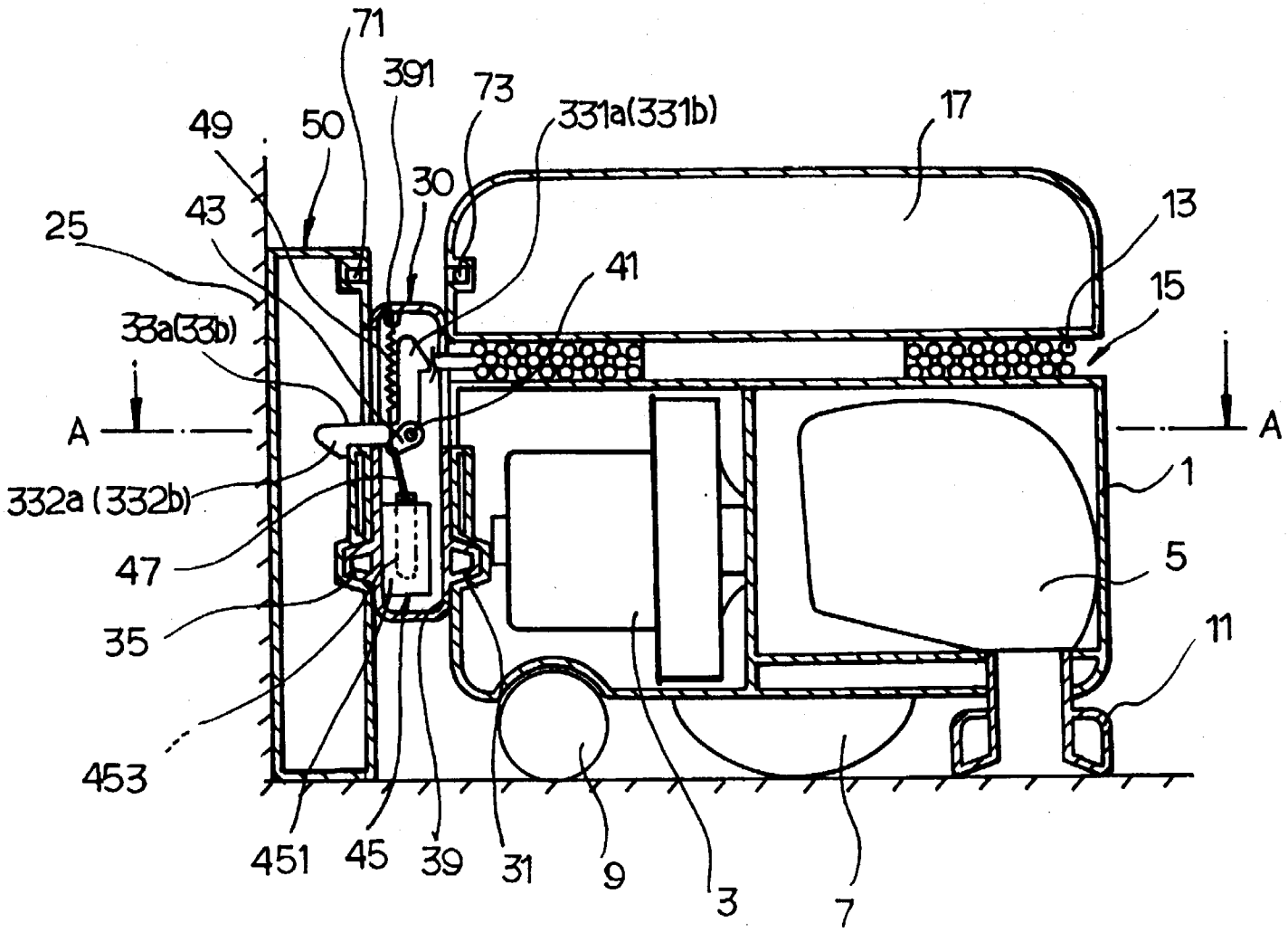
FIG. 2 is a longitudinal cross sectional view of a power supply apparatus of an automatic vacuum cleaner in accordance with the present invention.
Figure 3:
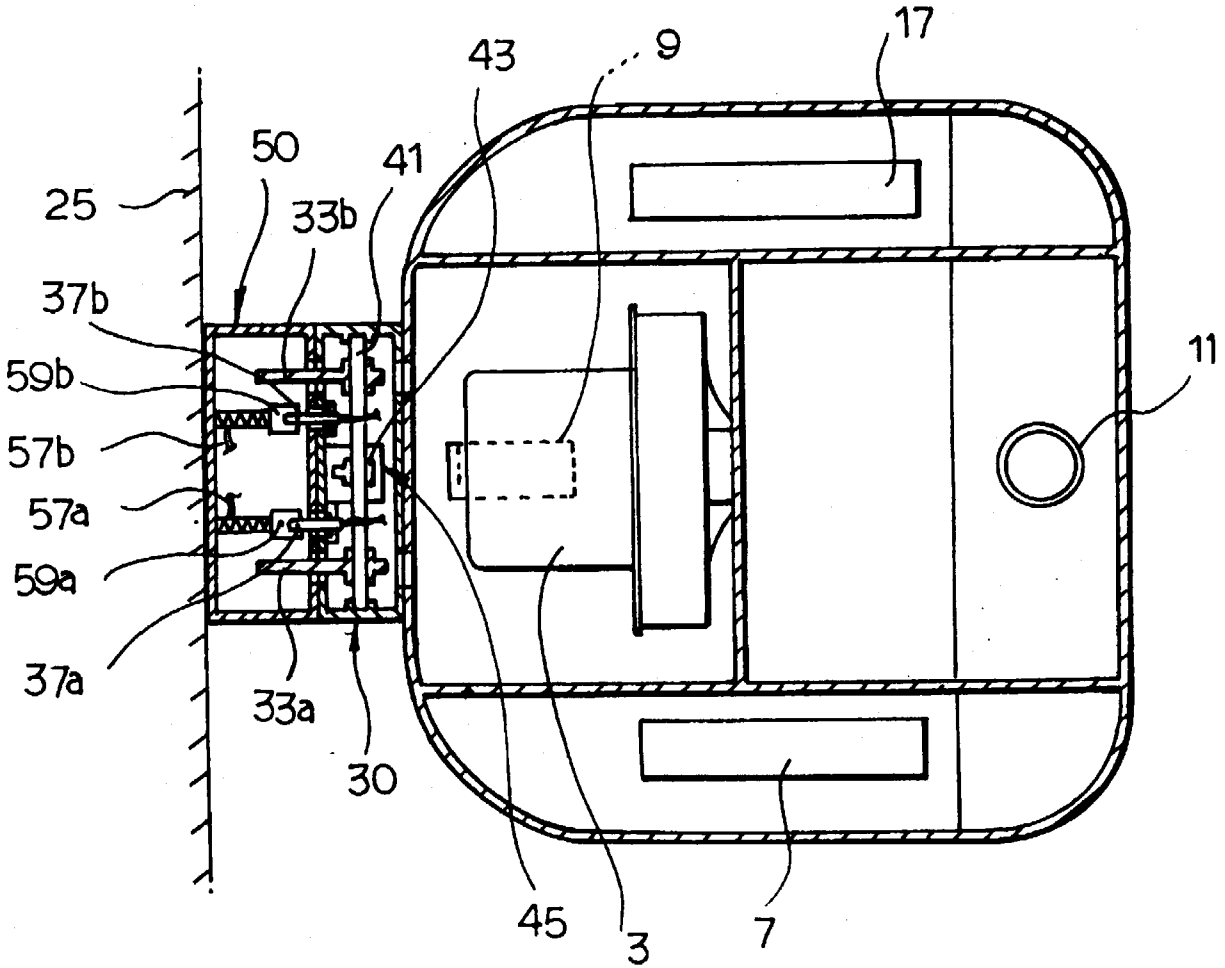
FIG. 3 is a sectional view taken along the section line 3—3 of FIG. 2.
Figure 4:
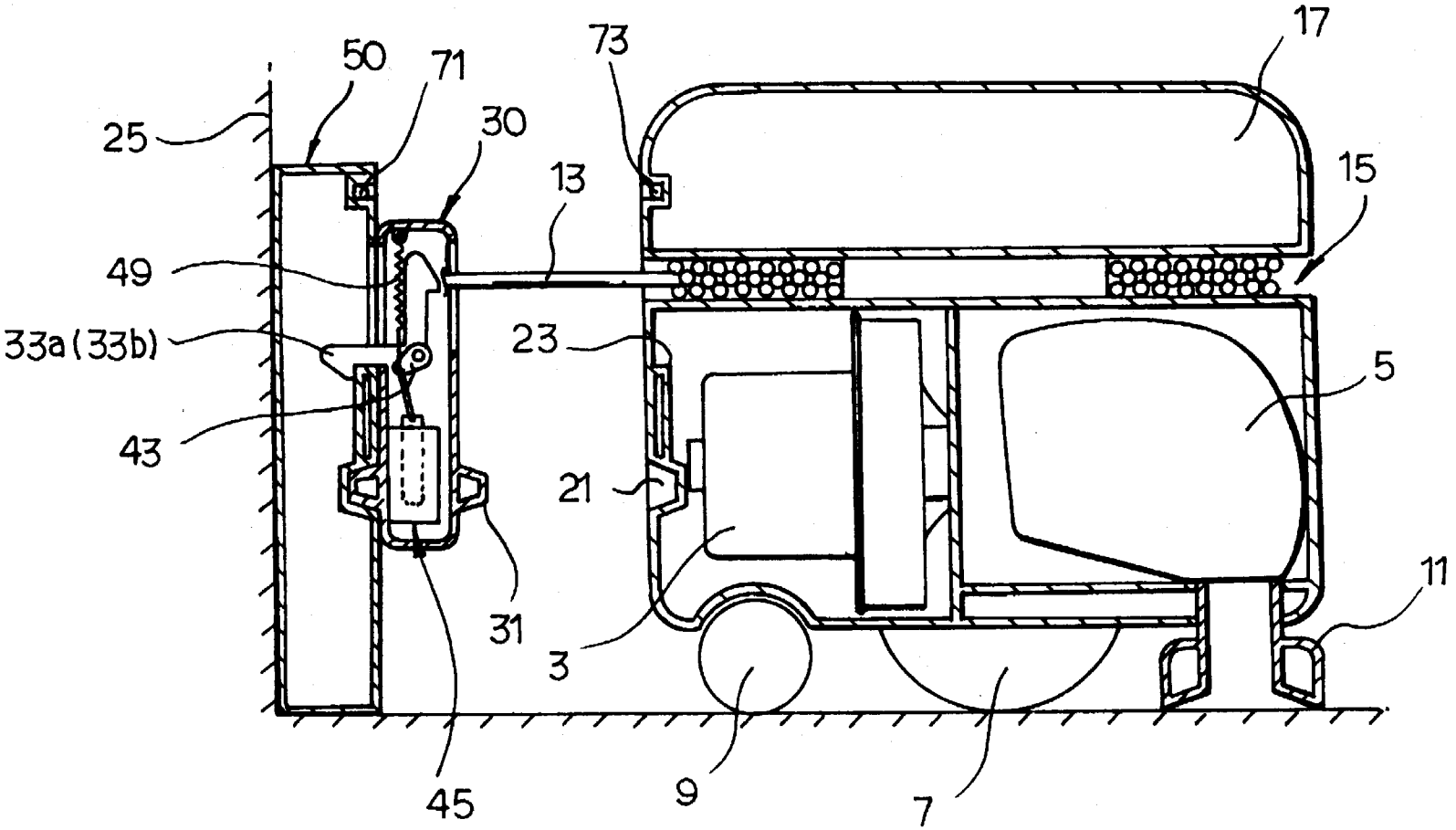
FIG. 4 is a longitudinal cross sectional view showing a condition wherein a plug means and socket means are coupled to each other, as shown in FIG. 2.
Figure 5:
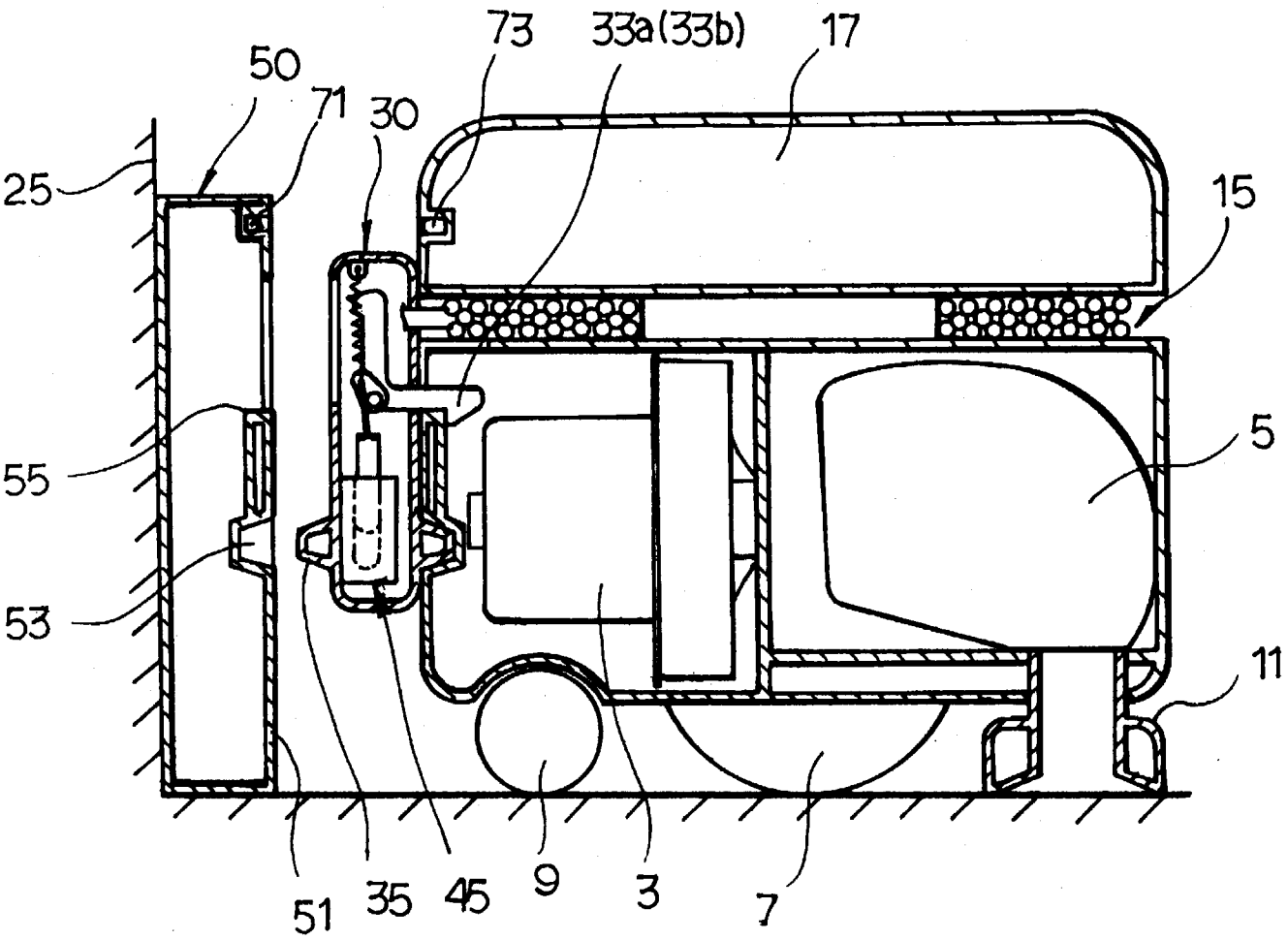
FIG. 5 is a longitudinal cross sectional view showing a condition wherein the plug means is separated from the socket means.

As is apparent from FIG. 2 plug body 39 forming the plug means 30 carries a rotatable shaft member 41, and as is apparent from FIG. 3 the shaft member 41 is at upper and lower parts thereof fixedly connect to the latches 33*a*, 33*b* 34*a*, 34*b* for latching the plug means 30 to the first and second lockers 23, 55 by rotation of the shaft member 41.

The shaft member 41 is fixed to a link member 43 for rotating the same shaft member 41 in clockwise or counterclockwise directions.

The member 43 is at a lower side thereof fixed to a solenoid 45 to be rotated thereby. The solenoid 45 is mounted in the body 39 and comprises a fixed member 451 and a movable member 453. The movable member 453 is moved by magnetic force generated within the fixed member 451. At that time, the movable member 453 is moved downward within the fixed member 451. The movable member 453 is at an upper side thereof connected to one end of a connection member 47 for transferring a force from the solenoid 45 to the link member 43. The connection member 47 is at the other end thereof connected to one end of the member 43.

Resilient means 49 is at one end thereof connected to the point where the connection member 47 is connected to the link member 43, and is at the other end thereof connected to a protrusion 391 formed on the top side of the body 39 so that the movable member 453 is pulled upwardly when the operation force of the solenoid 45 is released due to cut off of power electric.

Furthermore, the body 39 is at a left side thereof formed with the outwardly protruding connection terminals 37*a*, 37*b* which at one end thereof are electrically connected to wires 13*a*, 13*b* provided within the power cord 13.

The latches 34*a*, 34*b* include first hooks 331*a*, 331*b* for being hooked to the first locker 23, and the latches 33*a*, 33*b* include second hooks 332*a*, 332*b* for being hooked to the second locker 55.

In operation of the power supply apparatus for the automatic vacuum cleaner of this invention, the user inputs control program to the control means 17 for controlling the cleaner's movement on the floor to be cleaned. The user positions the vacuum cleaner in the vicinity of the socket means 50 so that the light receiving unit 73 is able to receive light emitted by the emitting unit 71, as instructed by the control program in the control means 17. When the user operates the operation switch (not shown) of the control means 17 the cleaner is supplied with power electric from a battery (not shown) in the control means 17.

Accordingly, the cleaner approaches the socket means 50 on the wall 25 under the control of the control means 17. At this time, the light receiving unit 73 receives light emitted from the light emitting unit 71 so that the cleaner moves toward the socket means 50 according to the control signal output from the control means 17 based on the detected light signal. At this time, the plug means 30 is attached to the left side of the cleaner by the latches 34*a*, 34*b*.

When the cleaner approaches the socket means 50 to insert the second protrusion 35 into the second receiving groove 53, the connection terminals 37*a*, 37*b* are inserted into the terminal receiving grooves of the contact terminals 59*a*, 59*b* to thereby electrically connect the wires 13*a*, 13*b* or the power cord 13 to the wires 57*a*, 57*b*.

Accordingly, the cleaner ceases to be powered by the battery, but rather is powered from the socket means 50 under the control of the control means 17.

Next, the solenoid 45 is operated to thereby move the movable member 453 downward within the fixed member 451. Thus, the link member 43 is pulled downward to rotate the shaft 41 in a counterclockwise direction.

Thus not only the shaft member 41 but also the latches 33*a*, 33*b* 34*a*, 34*b* are also rotated counterclockwise whereby the first hooks 331*a*, 331*b* of the latches 34*a*, 34*b* are released from the first locker 23 of the body 1, and the second hooks 332*a*, 332*b* of the latches 33*a*, 33*b* are latched to the second locker 55 of the socket means 50.

Meanwhile, when the cleaner body 1 moves away from the socket means 50 under the control of the control means 17, the first protrusion 31 of the plug means 30 is separated from the first receiving groove 21 of the body 1 to thereby attach the plug means 30 to the socket means 50, and accordingly the cord 13 is drawn out from the activating means 15. At this time, the battery in the control means 17 is charged with electric power supplied from the socket means 50.

As described above, when the cleaner has finished the cleaning operation or the power cord 13 can not be further extracted, the cleaner approaches the socket means 50 on the wall 25 under the control of the control means 17 so that the light receiving unit 73 may receive light emitted from the light emitting unit 71. Thus, the cleaner body 1 becomes reattached to the plug means 30, and the first protrusion 31 of the plug means 30 is inserted into the first receiving groove 21 of the body 1.

Next, when the solenoid 45 becomes deenergized due to cut off of the power electric under the control of the control means 17, the link member 43 is pulled upward by the resilient member 49 and is rotated in a clockwise direction.

Thus not only the shaft member 41 but also the latches 33*a*, 33*b*, 34*a*, 34*b* are rotated in the clockwise direction, to thereby release the second hooks 332*a*, 332*b* of the latches 33*a*, 33*b* from the second locker 55 of the socket means 30, and attach the first hooks 331*a*, 331*b* of the latches 34*a*, 34*b* to the first locker 55 of the body 1. At this time, the movable member 453 of the solenoid 45 is moved upward in the fixed member 451.

Next, when the body 1 moves away from the socket means 50 under the control of the control means 17, the second protrusion 35 of the plug means 30 is separated from the second receiving groove 53 of the socket means 50 to thereby connect the plug means 30 to the body 1, and at the same time the connection terminals 37*a*, 37*b* are separated from the terminal receiving grooves of the contact terminals 59*a*, 59*b*.

Accordingly, the cleaner will not be supplied with electric power from the socket means 50, but rather will be supplied with the power from only the battery. Under the above condition the cleaner moves to another socket means in the same predetermined area or another predetermined area under the control of the control means 17 and by the induction signal of the light emitting unit 71 of the other socket means.

When the cleaner has moved to the other socket means, the same operation is performed as described above.

The power supply apparatus according to the present invention has as an advantage that the plug means of the cleaner is automatically coupled with the socket means on the wall when the cleaner starts its cleaning operation at the predetermined area, and is automatically separated from the socket means in order to move to another predetermined area to be cleaned when the cleaner has finished its cleaning operation at the first predetermined area.

Having described the specific preferred embodiment of the invention with reference to the accompanying drawings, it is to be understood that the invention is not limited to that precise embodiment, and that various changes and modifications may be effected therein by one skilled in the art without departing from the scope or spirit of the invention as defined in the appended claims.

What is claimed is:

1. In combination; an automatic vacuum cleaner and an electrical socket, said socket including plug-receiving means and a light beam emitting unit;

said vacuum cleaner including:

a power cord, including a plug connectible to said plug-receiving means, a power cord actuating means for drawing-in said cord and permitting extraction of said cord, driving wheels;

an electric motor operably connected to the driving wheels;

a controller operably connected to said electric cord and said motor for supplying electric power to said motor, and a light beam receiving unit operably connected to said controller for receiving a light beam from said light emitting unit for providing a signal to said controller to operate said motor and said driving wheels for guiding said vacuum cleaner to said socket.

2. The combination according to claim 1, wherein said plug comprises a body, a plurality of latches movably mounted in said body, and means for moving said latches selectively into engagement with said socket and said vacuum cleaner.

3. The combination according to claim 2, wherein said latches are mounted for rotation about an axis, and further including an actuator mounted in said body for rotating said latches.

4. The combination according to claim 3, wherein said actuator comprises a solenoid.

5. The combination according to claim 4, wherein said solenoid is connected to rotate said latches in one direction, and further including a resilient member for rotating said latches in the other direction.

6. The combination according to claim 2, wherein said body includes a pair of electrical terminals connectible in respective electrical grooves of said socket.

7. The combination according to claim 2, wherein said plug is connectible to said body by a first protrusion/groove connection and is connectible to said socket by a second protrusion/groove connection.

* * * * *